United States Patent [19]

Gitman

[11] Patent Number: 5,062,789

[45] Date of Patent: Nov. 5, 1991

[54] ASPIRATING COMBUSTION SYSTEM

[76] Inventor: Gregory M. Gitman, 3642 Frederica Rd., Duluth, Ga. 30106

[21] Appl. No.: 574,500

[22] Filed: Aug. 27, 1990

Related U.S. Application Data

[63] Continuation of Ser. No. 203,803, Jun. 8, 1988, abandoned.

[51] Int. Cl.[5] ..... F23D 21/00

[52] U.S. Cl. ..... 431/9; 431/10; 431/116; 431/160; 431/351; 239/132.3; 239/129; 239/427.5

[58] Field of Search ..... 431/5, 9, 115, 116, 431/160, 351, 352, 10; 122/6.6; 239/129, 132.3, 427.3, 427.5

[56] References Cited

U.S. PATENT DOCUMENTS

| | | | |
|---|---|---|---|
| 2,217,518 | 10/1940 | Merkt | 431/9 |
| 2,424,765 | 7/1947 | McCollum | 431/116 X |
| 3,869,244 | 3/1975 | Von Linde et al. | 431/116 |
| 4,130,388 | 12/1978 | Flanagan | 431/116 |
| 4,378,205 | 3/1983 | Anderson | 431/5 |
| 4,541,796 | 9/1985 | Anderson | 431/187 |
| 4,575,332 | 3/1986 | Oppenberg et al. | 431/9 |
| 4,622,007 | 11/1986 | Gitman | 432/13 |
| 4,642,047 | 2/1987 | Gitman | 432/13 |
| 4,659,305 | 4/1987 | Nelson et al. | 431/9 |
| 4,708,638 | 11/1987 | Brazier et al. | 431/116 |

FOREIGN PATENT DOCUMENTS

| | | | |
|---|---|---|---|
| 3048201 | 7/1982 | Fed. Rep. of Germany | 431/9 |
| 698542 | 1/1931 | France | 431/115 |
| 52-0022134 | 2/1977 | Japan | 431/116 |
| 55-0023869 | 2/1980 | Japan | 431/116 |

*Primary Examiner*—Carl D. Price

*Attorney, Agent, or Firm*—Thomas, Kerr & Kayden

[57] ABSTRACT

Furnace gas is aspirated through furnace gas conduits (44) to the low pressure throats (42) of the Venturi conduits (41) that move high oxygen content gas to the combustion chamber (28) of the aspirating burner (20). Fuel is injected through fuel conduit (46) to the combustion chamber (28) to mix with the gases and form the flame in the combustion chamber which is emitted at high velocity from the burner into the furnace.

16 Claims, 3 Drawing Sheets

FIG.8
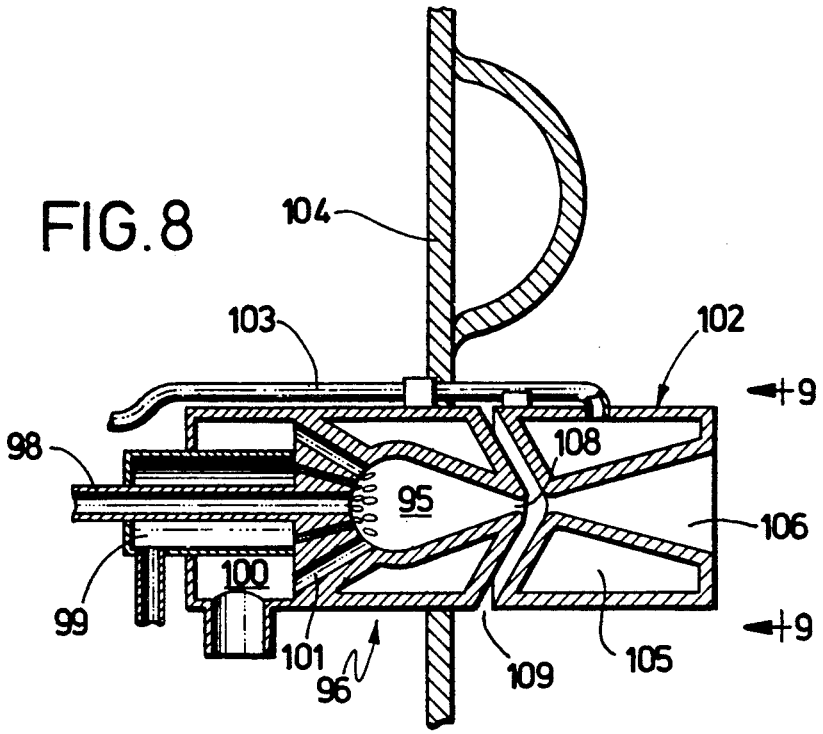
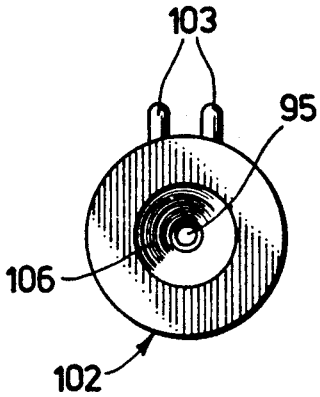
FIG.9
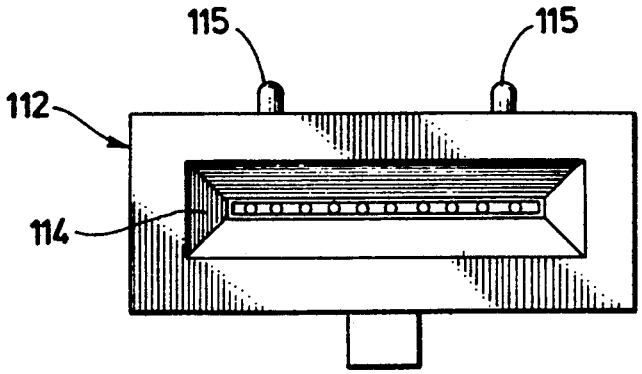
FIG.10

ASPIRATING COMBUSTION SYSTEM

This is a continuation of co-pending application Ser. No. 203,803, filed on June 8, 1988, now abandoned.

FIELD OF THE INVENTION

The present invention relates to a combustion method and apparatus which utilizes a highly oxygen-concentrated oxidizing gas to burn fluid combustible materials in a furnace. More particularly, the invention relates to a detoxification burner for use in an industrial furnace which functions to aspirate and reburn the gases of combustion emitted from the heating of a work product or the burning of a waste material in the furnace so as to reduce the products of incomplete combustion and to reduce airborne contaminants in the flue furnace gas.

BACKGROUND OF THE INVENTION

Oxygen enriched air and pure oxygen have been utilized as an oxidizing gas for combustion purposes in furnaces for some time. Partial or complete substitution of oxygen for air and other oxidizing gases in combustion processes has resulted in a substantial decrease in flue gas volumes as well as a significant increase in flame adiabatic temperatures and the percent of heat available for heating processes. On the other hand, the utilization of a highly concentrated oxidizing gas, in many case, has caused a rapid deterioration of furnace components, increased NOx emissions and localized overheating of the load and furnace lining.

To overcome some of the above limitations of prior art combustion systems, U.S. Pat. No. 4,378,205 describes a method and apparatus utilizing a step of injecting into the furnace atmosphere at least one jet of an oxidant gas with high oxygen content by volume which has the necessary velocity and direction to aspirate the furnace gases from the vicinity about the oxidant jet into the oxidant jet, and further to mix the oxidant jet with a fuel jet inside of the furnace interior to form the flame. The aspiration of the furnace gases into the flame in this manner tends to cause the furnace gases to be reburned in the flame.

The described open stream oxidant gas method tends to reduce the adiabatic temperature of the oxygen enriched flame formed in the furnace atmosphere and provides for dilution of the flame generated inside the furnace atmosphere with combustion products aspirated from the furnace chamber by the oxidant gas which travels inside of the furnace atmosphere prior to participation in combustion. Delaying the mixing of the gases between the fuel jets and the oxidant gas jets in addition to dilution of the oxidant jet within the furnace atmosphere causes the flame to have a low luminosity, diminishes the heat release density at the burner nozzle and reduces NOx formation by eliminating the high temperature flame core. This combustion method uses furnace space to accomplish the dilution of at least a part of the oxidizing gas with furnace gases prior to the oxidizing gas becoming involved with the fuel. Also this combustion method has the capability to reduce NOx formation and to decrease adiabatic flame temperatures but has substantial limitations.

First, this open stream oxidant gas method requires a substantial part of the working volume of the furnace combustion chamber to be empty for the mixing of the fuel and oxidant gas to develop the flame within the working volume of the combustion chamber of the furnace before the flame engages in the heating of the load or work product in the combustion chamber. Any contact of the oxidant gas with the surface of the load prior to mixture with the fuel would accelerate oxidation of the heated products. The low heating density specifically in the area surrounding the burner necessitates an increase in the furnace working volume for flame development and therefore increases the capital cost of the heating equipment.

The open combustion approach does not utilize a burner combustion tunnel for fuel and oxidant gas mixing to provide flame stability and flame velocity through the shaping of the hot expanded combustion gasses generated in a burner tunnel prior to discharging into the furnace atmosphere. The absence of a burner combustion tunnel makes the flame substantially less stable and therefore reduces flame velocity and therefore reduces the rate of convective heat transfer from the flame to the load. The convective heat exchange from combustion products to the load is desirable to insure rapid and uniform heating of the load.

There exists, therefore, a need for an aspirating combustion system and method which utilizes a highly oxygen-concentrated oxidizing gas which results in more efficient heating of the load with a flame in industrial furnaces and results in reburning inside the combustion chamber of the burner some of the gases of the furnace atmosphere which reduces the products of incomplete combustion and air borne contaminants in the flue gas.

There also exists a need for a method of heating within an industrial furnace which results in maximization of the furnace throughput, keeping adequate uniformity of heating.

There exists a still further need for a combustion system and method which can utilize a highly oxygen-concentrated oxidizing gas to provide a high velocity flame and a high temperature turbulence furnace atmosphere having a low NOx content in the flue gases.

SUMMARY OF THE INVENTION

Briefly described the present invention relates to an aspirating combustion system for high temperature furnaces utilizing a oxygen-concentrated oxidizing gas for combustion of a fluid fuel. The aspirating combustion system comprises a gas train to supply controllable flows of fluid fuel such as natural gas, oil, pulverized coal, etc. and at least one controllable flow of oxidizing gas with an oxygen concentration above 21%, such as produced oxygen or oxygen enriched air.

The oxidizing gas may be supplied to the burner as a single flow or as two separate flows, and one of the flows can be an oxidant which has an oxygen content above 21%. In addition to the gas train such combustion system comprises an aspirating burner which provides for the introduction into the combustion chamber of the burner the gases of combustion from the furnace chamber.

In one embodiment of the invention the burner includes passages for directing a stream of fluid fuel and a stream of an oxidizing gas into the burner combustion chamber wherein at least a portion of the oxidizing gas is directed into the burner combustion chamber with high velocity through a Venturi passage located inside the burner body. A hot furnace gas passage communicates at one end with the furnace interior and at its other end with the throat or zone of low pressure in the Venturi passage. The two communicating passages are shaped and arranged in such a way that the high velocity stream of the oxidizing gas directed through the Venturi passage causes the furnace atmosphere gases to be aspirated or inducted through hot gas passage to mix with the oxidizing gas prior to the oxidizing gas coming in contact with the stream of fuel inside the combustion chamber of the burner.

The volume of hot gas aspirated from the furnace atmosphere is approximately proportional to the volume of oxidizing gas directed through the Venturi passage so that the control of the volume of aspirated hot furnace gas can be achieved by controlling the flow of the oxidizing gas supplied through the Venturi passage. The Venturi passage can be constructed as a multiplicity of passages each having a Venturi shape and each communicating at the Venturi throat section with a hot furnace gas passage. The entire flow of oxidizing gas used to burn the fluid fuel can be supplied to the combustion chamber through the Venturi passage in the first embodiment of the aspirating burner.

Another embodiment of the invention utilizes an additional oxidizing gas passage to supply a first fraction of oxidizing gas to the combustion chamber without mixing the oxidizing gas with the aspirated furnace atmosphere gases. When such modified embodiment of the aspirating burner is utilized, the oxidizing gas can be supplied to the burner as a single stream having an oxygen content substantially above 21% or as two separate streams one of which can be oxygen or oxygen enriched air and the other gas can have different oxygen content, for example ambient air. When two oxidizing gases having different oxygen content are used, the higher oxygen content gas can be delivered into the combustion chamber through the additional non-Venturi passage which opens into base of the combustion chamber so as to create and stabilize the flame in the burner combustion chamber. The second stream of oxidizing gas having lower oxygen content can be directed through the Venturi passage and to the combustion chamber to aspirate the furnace atmosphere into the combustion chamber of said burner. The volume of the second stream can be varied to change the rate of flow of aspirated hot furnace gases from the furnace chamber.

Another embodiment of the aspirating burner includes an initial combustion chamber with a flame exhaust tunnel that diverges to form a gas induction nozzle, and a main combustion chamber communicating at one end with the diverging throat of the flame exhaust tunnel and at its other end with the furnace interior. The flame emitted from the initial combustion chamber through the diverging flame exhaust tunnel induces the hot furnace gases to flow into the burner main combustion chamber and mix with the flame emerging from the initial chamber.

BRIEF DESCRIPTION OF THE DRAWINGS

FIG. 8 is a cross-sectional view of a fifth embodiment of an aspirating burner taken along the longitudinal axis of the burner.

FIG. 9 is an end view of the burner shown in FIG. 8, taken along lines 9—9 of FIG. 8.

FIG. 10 is an end view of an aspirating burner similar to the burner of FIG. 8 but of rectangular configuration.

DETAILED DESCRIPTION OF THE INVENTION

Figure 1:
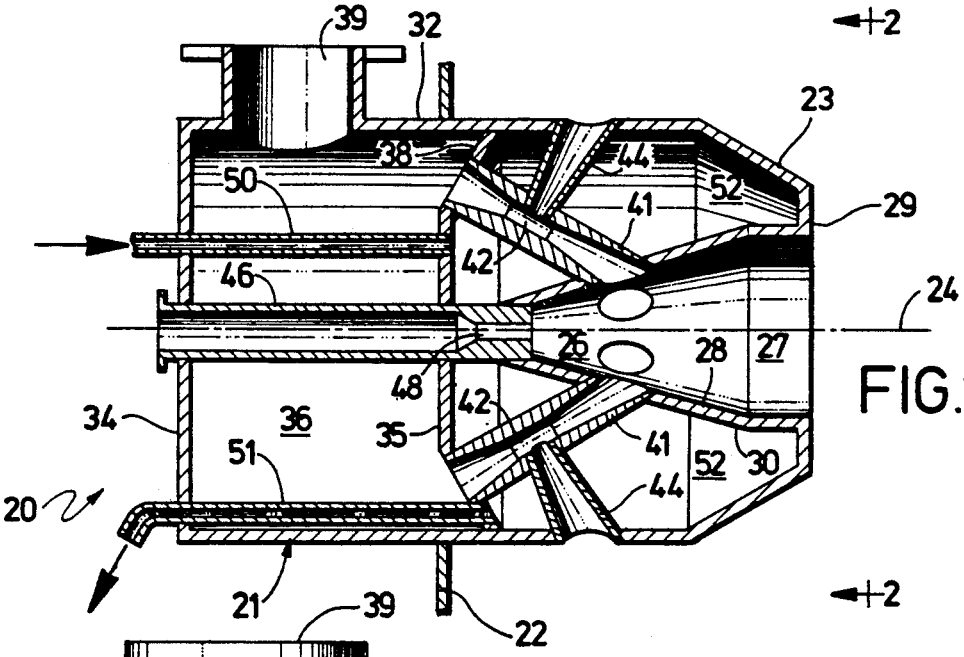
FIG. 1 is a cross-sectional view of a first embodiment of an aspirating burner taken along the longitudinal axis of the burner.

Referring now in more detail to the drawings, in which like numerals indicate like parts throughout the several views, FIG. 1 illustrates an aspirating burner 20 that includes a burner body 21 that is to be mounted into the wall 22 of an industrial furnace, etc. The burner body 21 is approximately cylindrical in shape, having a slight taper so as to make a slip fit into the wall of the furnace from outside the furnace and having a beveled face 23 that is exposed to the furnace atmosphere. The burner body has a longitudinal axis 24, and a diverging throat area 26 and combustion chamber 27 are symmetrically formed in the burner body about the longitudinal axis 24, with the combustion chamber 27 diverging from the throat area 26 in the central portion of the burner to form a diverging outlet nozzle 28. The outlet nozzle 28 intersects the nose 29 of the burner, and the burner usually is arranged in the wall of the furnace so that the combustion chamber 27 is directed into the interior of the furnace toward a load or work product within the furnace. A generally conical wall 30 forms the surfaces of the combustion chamber 27.

The exterior of the burn body is formed by the approximately cylindrical wall 32, and rear wall 34 closes the cylindrical wall at a position outside the furnace. Interior wall 35 is located in the burner body 21 and rear wall 34 and interior wall 35 are approximately perpendicular to longitudinal axis 24 and with cylindrical wall 32 form gas plenum chamber 36. Annular interior wall 38 extends from the circular outer edge of interior wall 35 outwardly to engage the outer cylindrical wall 32 of the burner body. Gas inlet opening 39 is formed in exterior burner wall 32 for the purpose of admitting oxygen rich air or other high oxygen content gas to the gas plenum chamber 36.

A plurality of Venturi conduits 41 each have their opposite open ends extending through annular interior wall 38 and conical wall 30 of the burner, with a constricted throat area 42 formed intermediate its ends. Hot furnace gas conduits 44 each communicate at its opposite ends through exterior cylindrical wall 32 of the burner and through the walls of a Venturi conduit at the throat area 42. Preferably the furnace gas conduits converge in cross-sectional area from outside the burner toward the throat areas of the Venturi conduits 41.

Fuel conduit 46 extends through rear wall 34 and through interior wall 35 along the longitudinal axis 24 of the burner body and includes a constricted fuel supply passageway 48 which opens into combustion chamber 27. A hydrocarbon fuel, such as natural gas, fuel oil, or other type of fuel compatible with the system is supplied through the fuel conduit 46 to the burner combustion chamber 27.

Liquid coolant supply conduit 50 extends through rear wall 34 and interior wall 35, while liquid coolant exhaust conduit 51 extends through rear wall 34 and annular interior wall 38. Conduits 50 and 51 move a continuous supply of cooling liquid into coolant chamber 52. Coolant chamber 52 surrounds conical wall 30 of the combustion chamber and surrounds interior conduits 41 and furnace gas conduits 44 and a portion of fuel supply conduit 46. With this arrangement, the coolant moving through conduits 50 and 51 and through the coolant chamber 52 maintain the burner in a controlled, relatively cool condition.

Figure 2:
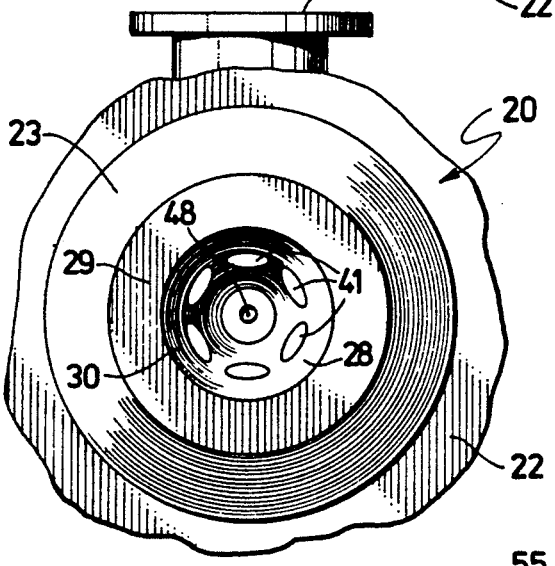
FIG. 2 is an end view of the burner shown in FIG. 1, taken along lines 2—2 of FIG. 1.

When the burner of FIGS. 1 and 2 is being operated, fuel is passed through fuel conduit 46 into diverging throat area 26. Oxidizing gas moves through the gas inlet opening 39 and into the gas plenum chamber 36, and then through the plurality of Venturi conduits 41 on into the diverging nozzle portion 28 between the diverging throat area 26 and combustion chamber 27. The oxidizing gas comprises oxygen rich air or other oxygen rich gas having more than twenty-one percent oxygen. As the oxygen rich gas moves through the Venturi conduit 41, the movement of the gas through the throats 42 of the Venturi conduits creates a low pressure condition and induces a flow of the furnace gas within the furnace to move through the furnace gas conduits 44 into the Venturi conduits 41, causing the hot gases of combustion from within the furnace to mix with the oxygen rich gas moving through the Venturi conduits and into the combustion chamber 27 of the burner.

The result of the mixing together of the oxygen-rich gas and the gases of combustion from the furnace is that some of the furnace gases will be recirculated through the flame emitted by the burner into the furnace, thereby reburning any airborne particles moving with the recirculated furnace gases. In the meantime, the oxygen-rich gas is diluted to some extent by the furnace gas, and the diluted gases are mixed with the fuel from fuel conduit 46 in the burner combustion chamber 27 so that the flame with reduced adiabatic temperature and NOx content is formed in the combustion chamber 27 and is emitted as a high velocity flame into the furnace.

Figure 3:
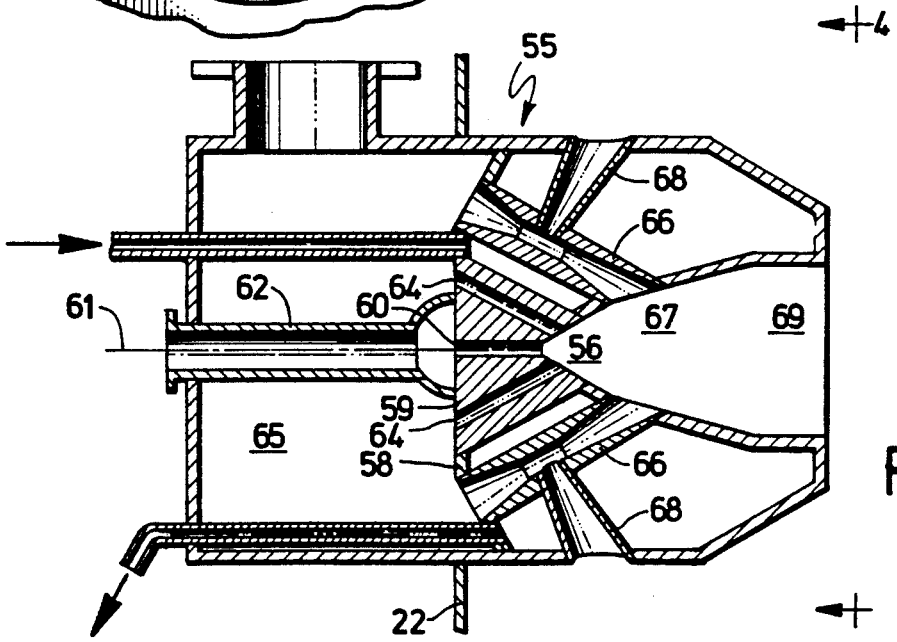
FIG. 3 is a cross-sectional view of a second embodiment of an aspirating burner taken along the longitudinal axis of the burner.
Figure 4:
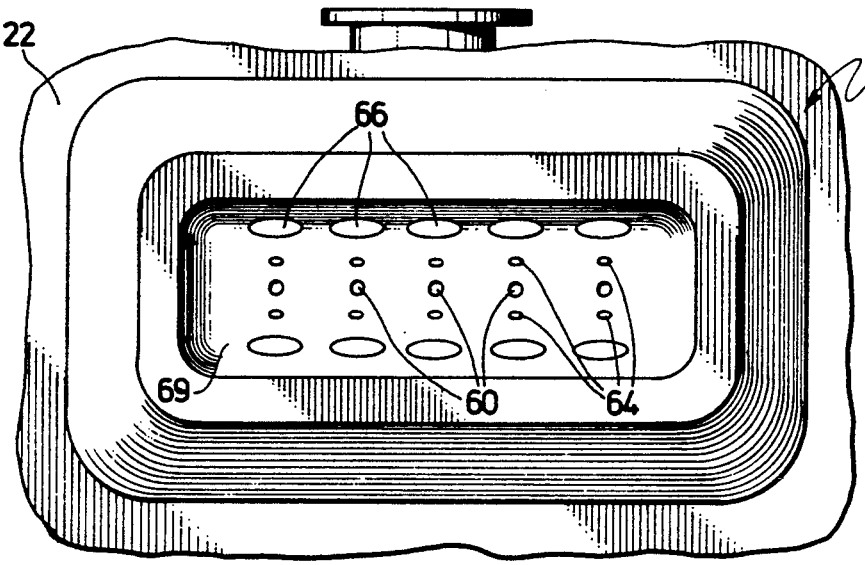
FIG. 4 is an end view of the burner shown in FIG. 3, taken along lines 4—4 of FIG. 3.

FIGS. 3 and 4 illustrate a second embodiment of the invention. As illustrated in FIG. 4, the burner 55 can be rectangular instead of cylindrical, but the general arrangement of the components remains the same, as shown in FIG. 3. The interior wall 35 of the embodiment of FIG. 1 is replaced in the embodiment of FIG. 3 by a smaller wall 58, and insert 59 engages the inner edge of the small wall 58. The insert 59 includes a fuel supply passage 60 which extends along the longitudinal axis 61 of the burner body and communicates at one of its ends with the fuel conduit 62 and at its other end with the initial combustion chamber 56. Additional oxidizing gas passages 64 extend through insert 59 and communicate at one end with gas plenum chamber 65 at the other end with initial combustion chamber 56. The burner includes an initial combustion chamber 56, a diverging throat or tunnel 67 and a main combustion chamber 69.

The second embodiment of the invention as illustrated in FIGS. 3 and 4 thus provides additional oxidizing gas passages 64 which function to move the oxidizing gas from gas plenum chamber 65 into the initial combustion chamber 56. In the meantime, Venturi conduits 66 also function to pass the oxidizing gas from gas plenum chamber 65 to the diverging throat 67 and main combustion chamber 69 and the movement of the oxidizing gas through the Venturi conduits 66 induces the flow of hot furnace gas through furnace gas conduits 68 into the diverging throat 67 and main combustion chamber 69.

Since the additional oxidizing gas passages 64 do not induce a flow of furnace gas into the initial combustion chamber 56, the oxygen-rich gas moving through these conduits into the initial combustion chamber is not diluted and is more suitable for forming and maintaining a stable fuel rich flame within the initial combustion chamber 56. After the fuel rich flame has been formed by the fuel and oxidizing gas at the throat 67 and the base of the main combustion chamber 69, the hot gas from the furnace moving through furnace gas conduits 68 mixes with oxygen-rich gas moving from plenum chamber 65 through the Venturi conduits 66 and the mixture flows into the throat 67 and main combustion chamber 69 and completes the oxidation of combustible components of the fuel rich flame and the furnace gases with the second oxygen rich gas.

Figure 5:
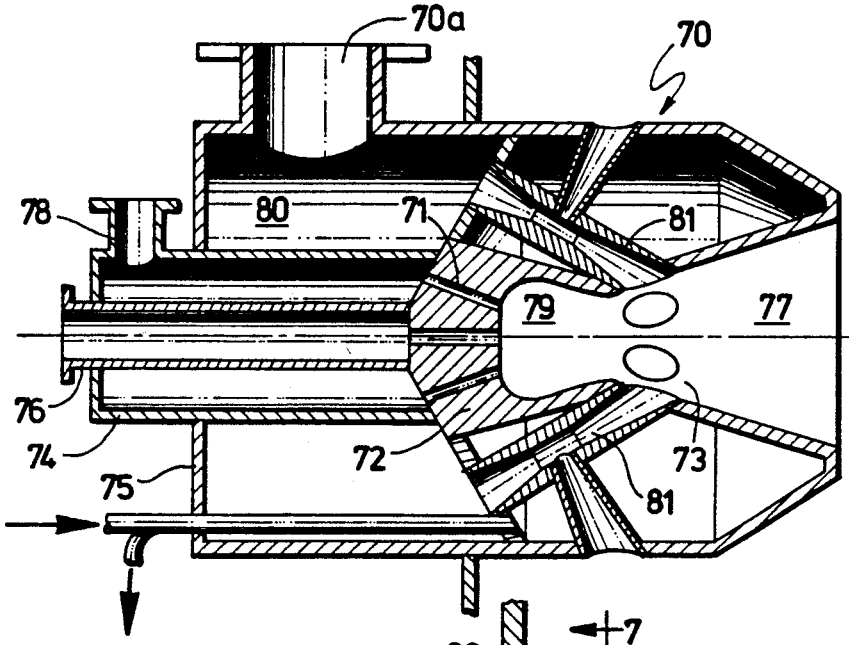
FIG. 5 is a cross-sectional view of a third embodiment of an aspirating burner taken along the longitudinal axis of the burner.

FIG. 5 illustrates a third embodiment of the invention in which the burner 70 is supplied with three separate gases so that two oxidizing gases having different oxygen content can be supplied from separate oxygen sources. As with the embodiment illustrated in FIGS. 3 and 4, additional oxidizing gas passages 71 are formed in the conical insert 72. However, in the embodiment of FIG. 5 a oxygen supply conduit 74 extends through rear wall 75 in a coaxial relationship about fuel supply conduit 76, and the oxygen supply conduit 74 communicates with the additional oxidizing gas passages 71. Oxygen-rich gas moves through the inlet opening 78 and into the oxygen supply conduit 74, and passes through the additional oxidizing gas passages 71 into the initial combustion chamber 79. Air or other oxidizing gas having different oxygen content moves through opening 70 into plenum chamber 80. With this arrangement, separate supplies of oxidizing gas containing different levels of oxygen and nitrogen can be fed to the initial combustion chamber 79 to create fuel rich combustion products and fed to the main combustion chamber 77 to complete the combustion. For example, oxygen-rich gas can pass through the oxygen supply conduit 74 and air can pass into the plenum chamber 80 and on through the Venturi conduits 81 into the main combustion chamber 77. With the separate gas supply arrangement of FIGS. 5, more precise control can be maintained of the oxygen and nitrogen concentration of the oxygen-rich gas moving into both the initial combustion chamber 79 and the main combustion chamber 77 of the burner.

Figure 6:
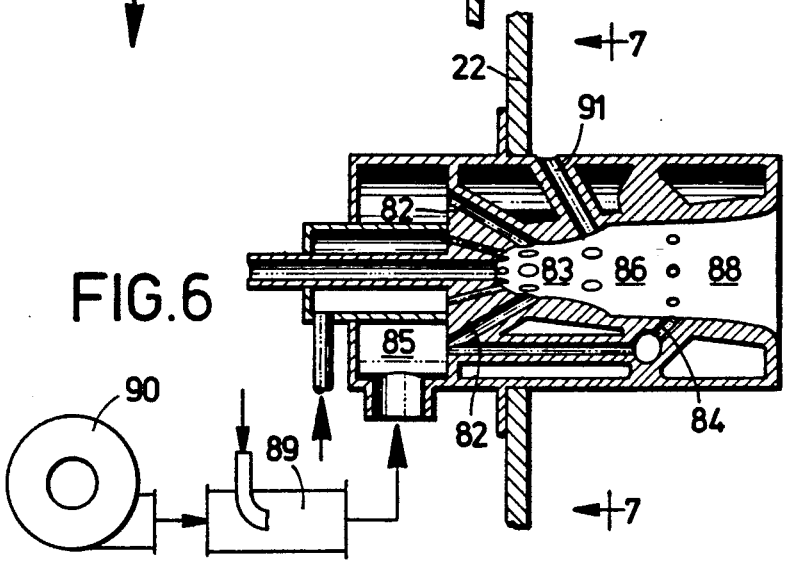
FIG. 6 is a cross-sectional view of a fourth embodiment of an aspirating burner taken along the longitudinal axis of the burner, and showing a schematic representation of a blower and a mixing valve which function to supply the burner with a high oxygen content gas dilluted by recirculated flue gases.
Figure 7:
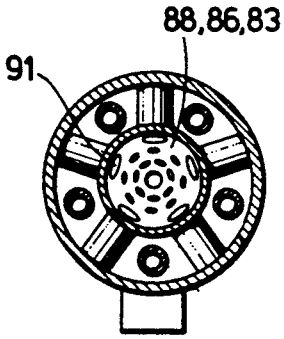
FIG. 7 is an end view of the burner shown in FIG. 6, taken along lines 7—7 of FIG. 6.

FIGS. 6 and 7 illustrate a fourth embodiment of the invention which includes an initial combustion chamber 83, intermediate combustion chamber 86 and main combustion chamber 88. A supply of one of the oxygen gases can be delivered in the initial combustion chamber 83 and in the main combustion chamber 88 and the hot furnace gas is inspirated to the intermediate combustion chamber 86 by the fuel rich combustion products created in the initial combustion chamber 83, to mix and react with this combustion product to reduce NOx molecules of the furnace atmosphere Passages 82 and 84 both communicate with plenum chamber 85 and move the second oxidizing gas from plenum chamber 85 into intermediate combustion chamber 86 and into main combustion chamber 88. Passages 82 open into the initial combustion chamber 83 while passages 84 open into the base of the main combustion chamber 88. Furnace gas conduits 91 extend from inside the furnace, through the burner to the diverging portion of the intermediate combustion chamber 86.

It will be noted that the intermediate combustion chamber 86 diverges outwardly at the openings of the hot furnace gas conduits 91 into the main combustion chamber 88. This configuration of the combustion chamber together with high velocity flame movement through the combustion chamber induce a low pressure at the vicinities of the openings of hot gas conduits 91 into the combustion chamber, so as to inspirate a flow of hot gas from the furnace through the hot gas conduits 91 into the combustion chamber. The hot gas conduits 91 introduce the hot gases of combustion from the furnace up stream of the intermediate combustion chamber 86 between the positions of passages 82 and 84.

As illustrated in FIG. 6, a mixer 89 can be used to add a fraction of flue gases exhausted from the furnace to a stream of second oxidizing gas, for example, air directed toward the burner from the blower 90. The mixer 89 is of conventional construction and adds a predetermined amount of exhausted furnace gases to the air or other oxidizing gas moving toward plenum chamber 85. This arrangement is usable on the other embodiments of the invention as disclosed herein, as may be desired to provide for a second stage of reburning of furnace gases after they exhaust from the furnace.

FIGS. 8 and 9 illustrate a fifth embodiment of the invention, whereby three gases are supplied to the combustion chamber 95 of the burner 96. Fuel enters through fuel conduit 98, high oxygen content gas enters through concentric conduit 99 and air or another oxidizing gas enters through plenum chamber 100. All three gases move to the combustion chamber at the base of the combustion chamber with the high oxygen content gas from concentric conduit 99 emerging in the combustion chamber about the fuel from fuel conduit 98 to form the initial flame core, and with another oxidizing gas having the lower oxygen content emerging from the plenum chamber 100 through ducts 101 in an array about the flame core formed at the base of the combustion chamber 95.

The burner includes a separate nozzle 102 suspended in spaced relationship out in front of the combustion chamber 95 of burner 96 by the cooling conduits 103 extending through the furnace wall 104. The cooling conduits 103 supply coolant to the separate nozzle assembly 102, with the coolant circulating within the nozzle plenum 105. The axial distance of a nozzle 102 from the burner 96 can be adjusted by sliding the coolant conduits 103 through the furnace wall 104.

The diverging throat 106 of nozzle 102 is aligned with the flame outlet opening 108 of combustion chamber 95, so that a converging/diverging flame tunnel is formed by the burner and its nozzle. The annular gap 109 formed between burner 96 and nozzle 102 functions as a hot furnace gas passage that permits the hot gases of combustion within the furnace to move through the gap 109 into the flame emerging from the combustion chamber 95 and passing into and through the diverging nozzle 106. The high velocity flame that traverses the gap between the burner and the nozzle tends to form an area of low pressure that induces the flow of furnace gas radially inwardly through the annular space 109 and into the flame emerging from the burner and nozzle.

The furnace gas has significantly less temperature than the adiabatic temperature of the flame being created and the furnace gas is used in this embodiment to dilute the combustion product, reducing its temperature and prevents excessive NOx formation.

The embodiment of the invention disclosed in FIGS. 8 and 9 comprises an approximately cylindrical burner 96 and cylindrical nozzle 102. However, the configuration of the burner and nozzle can be in the shape of a rectangle, as generally indicated by FIG. 10, with the rectangular nozzle 112 including a diverging throat or flame tunnel 114, and coolant conduits 115. The general elements of the burner and nozzle remain the same except for the rectangular configuration.

It will be understood that the foregoing description relates to preferred embodiments of the present invention, and that changes and modifications can be made therein without departing from the spirit and scope of the invention as set forth in the following claims.

I claim:

1. A method of firing a furnace with an ongoing hydrocarbon flame formed in a combustion chamber of a burner and emitted from the combustion chamber into a furnace comprising the steps of:

circulating a cooling liquid in the burner about the combustion chamber to cool at least a portion of the burner, injection a fluid hydrocarbon fuel into a combustion chamber of the burner mounted to a furnace, injecting an oxygen based gas having an oxygen content greater than atmospheric air into the combustion chamber, mixing the oxygen based gas with the fuel in the combustion chamber to form a flame in the combustion chamber, emitting the flame from the combustion chamber of the burner toward the furnace, and injecting the oxygen based gas into the combustion chamber through an oxygen based gas passage to form a zone of reduced pressure of the oxygen based gas in the burner, the zone being in communication with the furnace thereby inducing with the zone of reduced pressure the movement of some of the furnace gas from within the furnace through a passage within the liquid cooled portion of the burner and into the flame in the combustion chamber to reduce the temperature of the flame in the combustion chamber before the flame passes into the furnace.

2. The method of claim 1 and wherein the step of moving furnace gas from within the furnace through the burner and into the flame emitted from the combustion chamber of the burner comprises moving the furnace gas at a rate corresponding to the rate of movement of the oxygen based gas to the combustion chamber.

3. A method of firing a furnace with an ongoing hydrocarbon flame formed in a combustion chamber of a burner and emitted from the combustion chamber into a furnace comprising the steps of:

circulating a cooling liquid in the burner about the combustion chamber to cool at least a portion of the burner, injecting a fluid hydrocarbon fuel into the combustion chamber of the burner, injecting a fluid hydrocarbon fuel into the combustion chamber of the burner, injecting an oxygen based gas into the combustion chamber, mixing the oxygen based gas with the fuel in the combustion chamber to form a flame in the combustion chamber, emitting the flame from the combustion chamber of the burner toward the furnace, injecting the oxygen based gas into the combustion chamber through a passage that creates a low pressure zone of oxygen based gas in the passage, the zone being in communication with the furnace, and aspirating the furnace gas from within the furnace through a passage within the liquid cooled portion of the burner with the low pressure zone of oxygen based gas and mixing the furnace gas with the oxygen based gas as the oxygen based gas and the furnace gas move toward the burner combustion chamber to reduce the temperature of the flame in the combustion chamber before the flame passes into the furnace.

4. The method of claim 3 wherein the step of injecting an oxygen based gas into the combustion chamber of the burner comprises injecting a first oxygen based gas with an oxygen content greater than 21% in to the combustion chamber, and separately injecting a second oxygen based gas with an oxygen content less than the first oxygen based gas into the combustion chamber, and wherein the step aspirating a flow of furnace gas comprises aspirating a flow of furnace gas with only one of the first or second oxygen based gases.

5. A method of firing a furnace with a low temperature flame emitted from a combustion chamber of a burner, at least a portion of which is liquid cooled, comprising the steps of:

moving a fluid hydrocarbon fuel into a combustion chamber of a burner mounted to a furnace, moving an oxygen based gas having an oxygen content greater than atmospheric air into the combustion chamber of the burner through a gas passage having a zone of reduced pressure with the moving oxygen based gas as the oxygen based gas moves to the combustion chamber, with the zone of low pressure being in communication with the furnace, and drawing the furnace gas with the reduced pressure zone of moving oxygen based gas from within the furnace through a passage within the liquid cooled portion of the burner and into the moving oxygen based gas and diluting the oxygen based gas with the furnace gas drawn from within the furnace, mixing the fuel, oxygen based gas and furnace gas in the combustion chamber and forming a low temperature flame in the combustion chamber, and after the flame has been formed with the mixture including the furnace gas emitting the flame from the combustion chamber of the burner toward the furnace.

6. A hydrocarbon fluid fuel burner for mounting to a furnace and emitting a flame into the furnace, comprising:

a burner body for insertion partially through the wall of a furnace and projecting into the furnace, a combustion chamber defined in said burner body with a flame opening directed into the furnace, coolant circulating passage means in said burner body surrounding said combustion chamber for cooling the portion of said burner body projecting into the furnace, fuel conduit means for directing a flow of fuel from outside the furnace through said burner body into said combustion chamber, oxygen gas supply means outside the furnace for providing an oxygen based gas having an oxygen content substantially higher than 21%.

gas conduit means for directing a flow of the oxygen based gas from said supply means outside the furnace through said burner body into said combustion chamber for mixing with the fuel and forming a flame in said combustion chamber and emitting the flame through said flame opening into the furnace, furnace gas conduit means in communication with the furnace extending through the liquid cooled portion of said burner body projecting into the furnace and intersecting said gas conduit means for directing a flow of furnace gas from inside the furnace into said burner for reburning by the flame formed in said combustion chamber, and constricted passage means in said gas conduit means at the intersection of said furnace gas conduit means with said gas conduit means for forming a low pressure zone to aspirate a flow of furnace gas through the cooled portion of said burner body into the flow of oxygen based gas moving to said combustion chamber for mixing with and diluting the oxygen based gas moving to said combustion chamber.

7. The burner of claim 6 and wherein said gas conduit means comprises a first gas conduit means for moving gas with higher than 21% oxygen content to said combustion chamber and a second gas conduit means for moving gas with an oxygen content lower than the first gas.

8. The burner of claim 6 and wherein said gas conduit means comprises a first gas conduit means for communication with a first source of gas, and a second gas conduit means for communication with a second source of gas having a different oxygen content.

9. A method of combusting hydrocarbon fluid fuel in an ongoing hydrocarbon flame formed in a combustion chamber within a liquid cooled combustion block having an outlet nozzle directed into a hot furnace interior, to minimize the consumption of fuel and pure oxygen in the heating processes, comprising the steps of:

circulating a cooling liquid through the combustion block about the combustion chamber, separately supplying hydrocarbon fluid fuel and oxygen-based oxidizing gas to the combustion chamber of the combustion block, directing a first fraction of the oxidizing gas supplied to the combustion chamber through at least one opening in the combustion chamber wall toward the combustion chamber, directing the hydrocarbon fuel supplied to the combustion chamber in a stream directed through at least one opening int the combustion chamber wall toward the first fraction of oxidizing gas so that the hydrocarbon fuel is caused to be mixed in the combustion chamber with the first fraction of oxidizing gas to stabilize combustion within the combustion chamber thereby creating a highly luminous fuel-rich hot flame core extending throughout said combustion chamber;

directing the rest of the oxidizing gas through at least one opening in the combustion chamber wall into said combustion chamber in a stream directed about and toward the flame core so that the rest of the oxidizing gas initially insulates the flame core from cooling by contact with the liquid cooled combustion block prior to being mixed with the hydrocarbon fuel for final combustion to be conducted at least partially outside of the combustion chamber;

discharging the products of combustion from the combustion chamber through a liquid cooled nozzle opening toward the furnace interior;

moving furnace gas from within the furnace through at least one opening in the liquid cooled combustion block and further through the combustion chamber and into the flame and to enter the furnace with the products of combustion which are emitted from the combustion chamber of the burner, and controlling the flow of the hydrocarbon fuel, the oxidizing gas, and the cooling liquid toward the combustion chamber.

10. The method of claim 9 and wherein the step of moving furnace gas from within the furnace through the liquid cooled combustion block and into the combustion chamber of the burner block comprises moving the rest of oxidizing gas through at least one passages that creates a low pressure zone of oxidizing gas in communication with the furnace and aspirating the furnace gas from within the furnace with said low pressure zone and mixing the furnace gas with the rest of the fraction of oxidizing gas as this oxidizing gas and furnace gas move toward the burner combustion chamber.

11. The method of claim 9 and wherein the step of moving furnace gas from within the furnace opening in the combustion block and into the flame emitted from the combustion chamber of the burner comprises moving the furnace gas at a rate corresponding to the rate of movement of the rest of the fraction of oxidizing gas to the combustion chamber.

12. The method of claim 9 and wherein the step moving the furnace gas from within the furnace through the liquid cooled combustion block and into the products of combustion emitted from the combustion chamber of the burner comprises forming a zone of low pressure with the hot flame core in communication with the furnace and aspirating the furnace gas from within the furnace with the low pressure zone.

13. A method of combusting hydrocarbon fluid fuel in an ongoing hydrocarbon flame formed in a combustion chamber within a combustion block having an outlet nozzle directed into a hot furnace interior, to minimize the consumption of fuel and pure oxygen in the heating processes, comprising the steps of:

separately supplying hydrocarbon fluid fuel and first and second oxygen-based oxidizing gases of different oxygen content to the combustion chamber of the combustion block, directing the first oxidizing gas supplied to the combustion chamber through at least one opening in the combustion chamber wall toward the combustion chamber, directing the hydrocarbon fuel supplied to the combustion chamber in a stream directed through at least one opening in the combustion chamber wall toward the first oxidizing gas so that the hydrocarbon fuel is caused to be mixed in the combustion chamber with the first oxidizing gas to stabilize combustion within the combustion chamber thereby creating a highly luminous fuel-rich hot flame core extending throughout said combustion chamber;

directing a second oxidizing gas of lower oxygen content than the first oxidizing gas through at least one opening in the combustion chamber wall into said combustion chamber in a stream directed about and toward the flame core so that the second oxidizing gas initially insulates the flame core from being cooled by contact with the combustion block prior to being mixed with the hydrocarbon fuel for final combustion to be conducted at least partially outside of the combustion chamber;

discharging the products of combustion from the combustion chamber through a nozzle opening toward the furnace interior;

moving some of the furnace gas from within the furnace through at least one opening in the combustion block and further through the combustion chamber and into the flame so as to enter the furnace with the products of combustion which are emitted from the combustion chamber of the burner, and controlling the flow of the hydrocarbon fuel, the first oxidizing gas, and the second oxidizing gas toward the combustion chamber.

14. The method of claim 9 and wherein the step of moving furnace gas from within the furnace through the combustion block and into the combustion chamber of the burner block comprises moving the second oxidizing gas through at least one passage that create a low pressure zone of oxidizing gas in communication with the furnace and aspirating the furnace gas from within the furnace with said low pressure zone and mixing the furnace gas with the second oxidizing gas as the second oxidizing gas and furnace gas move toward the burner combustion chamber.

15. The method of claim 9 and wherein the step of moving furnace gas from within the furnace opening in the combustion block and into the flame emitted from the combustion chamber of the burner comprises moving the furnace gas at a rate corresponding to the rate of movement of the second oxidizing gas to the combustion chamber.

16. The method of claim 9 and wherein the step moving the furnace gas from within the furnace through the combustion block and into the products of incomplete combustion emitted from the combustion chamber of the burner comprises forming a zone of low pressure with the hot flame core in communication with the furnace and aspirating the furnace gas from within the furnace with the low pressure zone.

* * * * *